US006675535B2

(12) United States Patent
Armstrong et al.

(10) Patent No.: US 6,675,535 B2
(45) Date of Patent: Jan. 13, 2004

(54) REMOTE CONTROL DOOR OPERATING AND COUPLING ASSEMBLY

(76) Inventors: Richard Armstrong, 449 Norris Landing Rd., Swansboro, NC (US) 28584; Richard Armstrong, Jr., 908 McBryde Dr., Blacksburg, VA (US) 24060

( * ) Notice: Subject to any disclaimer, the term of this patent is extended or adjusted under 35 U.S.C. 154(b) by 388 days.

(21) Appl. No.: 09/742,434

(22) Filed: Dec. 22, 2000

(65) Prior Publication Data

US 2002/0078629 A1 Jun. 27, 2002

(51) Int. Cl.[7] ..... E05F 15/04
(52) U.S. Cl. ..... 49/340; 49/356
(58) Field of Search ..... 49/356, 339, 340, 49/344

(56) References Cited

U.S. PATENT DOCUMENTS 1,040,504 A * 10/1912 Bundy ..... 49/30
1,112,393 A * 9/1914 Spencer ..... 49/339
2,052,942 A * 9/1936 Ring ..... 49/356
2,361,040 A * 10/1944 Larsen ..... 49/340
3,099,438 A * 7/1963 Fritz ..... 49/139
3,936,977 A * 2/1976 Runft et al. ..... 49/137
4,735,018 A * 4/1988 Duncan et al. ..... 49/340
4,762,304 A 8/1988 Hill
4,796,385 A * 1/1989 Tyler ..... 49/280
4,850,094 A * 7/1989 Lybecker ..... 29/434
5,375,374 A * 12/1994 Rohraff, Sr. ..... 49/340
5,394,651 A * 3/1995 Vial ..... 49/394
5,433,037 A * 7/1995 Pazio ..... 49/139
5,513,467 A 5/1996 Current et al.
5,515,649 A * 5/1996 Strab ..... 49/280
5,788,295 A 8/1998 Fuss et al.
5,832,561 A 11/1998 Bienek
5,878,530 A * 3/1999 Eccleston et al. ..... 49/139
6,138,412 A * 10/2000 Rieckmann et al. ..... 49/349

* cited by examiner

*Primary Examiner*—Gregory J. Strimbu
(74) *Attorney, Agent, or Firm*—Roylance, Abrams, Berdo & Goodman, L.L.P.

(57) ABSTRACT

An apparatus for opening and closing a door remotely includes a remote radio control, electrically operated strike plate, and a door opening assembly attached to the door. A double acting piston is attached to a fixture on the floor. An actuator rod coupling assembly allows the door to move freely in a normal manner when the apparatus is deactivated. The coupling assembly has a detent which will release the piston rod in case of a sudden excessive force on the door that would otherwise damage the apparatus. The piston is a double acting piston that includes pressure switches to deactivate the pump when the pressure exceeds a threshold to prevent damage to the assembly. The mechanism can use potable water as the hydraulic fluid to eliminate contamination and fire hazards. The electrical system uses 12 volt DC operating voltages to eliminate electric shock.

28 Claims, 9 Drawing Sheets

REMOTE CONTROL DOOR OPERATING AND COUPLING ASSEMBLY

FIELD OF THE INVENTION

The present invention is directed to a remote control operating assembly for opening and closing a door. More particularly, the invention is directed to an assembly for opening and closing a door where the assembly can be deactivated to allow manual operation of the door without interference from the operating assembly.

BACKGROUND OF THE INVENTION

A number of door opening mechanisms are known in the art for automatically opening and closing a door. These devices are particularly desirable for use by people having disabilities that can have difficulties in opening doors.

The automatic door opening devices typically include a bracket mechanism extending between a door and a door frame and include a suitable motor or hydraulic pressure source driving a double acting piston for generating the necessary force to open the door. The amount of force required to open a door can vary in relation to the location of the operating mechanism. Many door operating mechanisms are constructed so that the mechanism engages the door at a point close to the hinge of the door. This arrangement requires considerable force to open and close the door, thereby requiring a large power source.

Various devices have been proposed for remote operation of a door. These devices generally include a remote control unit that can be operated by the user to selectively open and close the door. Examples of these prior devices are disclosed in U.S. Pat. No. 5,375,374 to Rohroff and U.S. Pat. No. 5,634,296 to Hebda. These devices include a receiving unit and an electric motor for operating the mechanism.

Automatic door operating mechanisms generally require a clutch mechanism to disengage the operating mechanism so that the door can be operated manually. Many automatic door operating devices use a slip type clutch that allows the door to be opened and closed without turning the shaft of the electric motor. However, a disadvantage of the clutch-type devices is that they produce a significant drag or resistance on the door when the door is operated manually. The clutch mechanism allows the clutch to slip during the opening or closing cycle when the door strikes an obstruction. Although the movement of the door stops, the door operating mechanism continues throughout the opening and closing cycle. In this manner, the force against the obstruction continues until the end of the opening or closing cycle which can cause injury to a person or damage to the mechanism.

The manual operation of many hydraulic operated door mechanisms requires considerable force to transfer the hydraulic fluid from one side of the double acting piston to the other.

Although these devices have been effective for their intended purpose, there is a continuing need in the industry for an improved door operating mechanism.

SUMMARY OF THE INVENTION

The present invention is directed to an automatic door operating mechanism. More particularly, the invention is directed to a door operating mechanism for opening and closing a door from a remote location.

Accordingly, a primary object of the invention is to provide a remote controlled door operating assembly for opening and closing a door that overcomes the disadvantages of the prior door opening devices.

Another object of the invention is to provide a door operating assembly that can be easily installed by the home owner to an existing door using commonly available tools.

A further object of the invention is to provide an automatic door operating assembly that can be deactivated to allow manual operation of the door with minimal interference or resistance by the door operating assembly during the manual operation of the door.

A further object of the invention is to provide a door operating assembly having a release mechanism to disengage the door operating assembly when a threshold force is applied to the door.

Still another object of the invention is to provide a door operating assembly having a release mechanism to effectively disengage the operating assembly from the door and prevent an opening or closing force applied to the door when the door meets an obstruction.

Another object of the invention is to provide a door operating assembly that is able to operate on a low voltage DC current to reduce the risk of injury caused by an electric shock.

A further object of the invention is to provide a door operating assembly including a double action hydraulic cylinder for selectively opening and closing the door.

Still another object of the invention is to provide a door operating assembly using a hydraulic piston and cylinder that can operate using water as the operating fluid.

Another object of the invention is to provide a door operating assembly having a hydraulic piston drive assembly and a releasable coupling mechanism for selectively coupling the door to the piston rod for engaging and disengaging the piston with the door.

Another object of the invention is to provide an automatic door operating assembly having a release mechanism with a spring biased detent for selectively engaging a piston rod of a drive assembly.

A further object of the invention is to provide a remote controlled door operating assembly having a door opening mechanism and a strike plate attached to the door frame where the strike plate is actuated to allow the door to open by the door operating mechanism.

These and other objects of the invention are basically attained by providing an apparatus for opening and closing a door hinged to a door frame. The apparatus comprises a first bracket mounted on a support surface and being in a fixed position with respect to the door. A door actuator assembly has a first end pivotally coupled to the first bracket and a second end. The actuator assembly further has an actuator rod extending from the second end of the actuator assembly and is movable between an extended position and a retracted position. A second bracket is coupled to the door at a location spaced from the door frame. The actuator rod is slidably coupled to the second bracket. A coupling assembly is coupled to the second bracket for selectively capturing the actuator rod to open and close the door by actuating the actuator rod between the extended position and the retracted position.

The objects and advantages of the invention are further attained by providing an automatic door operating assembly for opening and closing a door hinged to a door frame. The assembly comprises a first bracket mounted on a support surface, and is in a fixed position with respect to the door. A door actuator has a piston and cylinder assembly. The cylinder has a first end pivotally coupled to the first bracket and a second end spaced from the first end. An actuator rod has a first end coupled to the piston and a second end spaced from the second end of the cylinder. A second bracket is coupled to the door. A coupling assembly is provided for coupling the actuator rod to the second bracket. The coupling assembly includes a body coupled to the second bracket. The body has a hole defining a passage extending therethrough. The second end of the actuator rod extends through the hole and is slidable therein. A detent is coupled to the body. The detent is movable between an extended position for engaging and capturing the actuator rod and a retracted position for releasing the actuator rod. The actuator rod is movable between a retracted position to open the door and an extended position to close the door.

The objects and advantages of the invention are also attained by providing a remote operated door operating assembly for opening and closing a door hinged to a door frame. The assembly comprises a first bracket mounted on a support surface in a fixed position with respect to the door. A door actuator has a fluid operated piston and cylinder assembly. The cylinder has a first end pivotally coupled to the first bracket and a second end spaced from the first end. An actuator rod has a first end coupled to the piston and a second end spaced from the second end of the cylinder. The actuator rod is movable between an extended door closing position and a retracted door opening position. A second bracket is fixed to the door. A coupling assembly is provided for coupling the second end of the actuator rod to the second bracket. The coupling assembly has a coupling member movable between a retracted position and an extended position for capturing the actuator rod. A door latching assembly for latching the door in a closed position is provided. The latching assembly has a movable strike plate coupled to the door frame and is movable from a latching position to an open position to allow the door to open. A remote control device is provided for operating the door actuator, coupling assembly and latching assembly from a remote location to selectively open and close the door. The door can be opened manually when the coupling member is in the retracted position without interference from the door actuator.

The objects, advantages and other salient features of the invention will become apparent from the following detailed description of the invention in connection with the annexed drawings which form a part of this original disclosure.

BRIEF DESCRIPTION OF THE DRAWINGS

The following is a brief description of the drawing, in which.

DETAILED DESCRIPTION OF THE INVENTION

Figure 1:
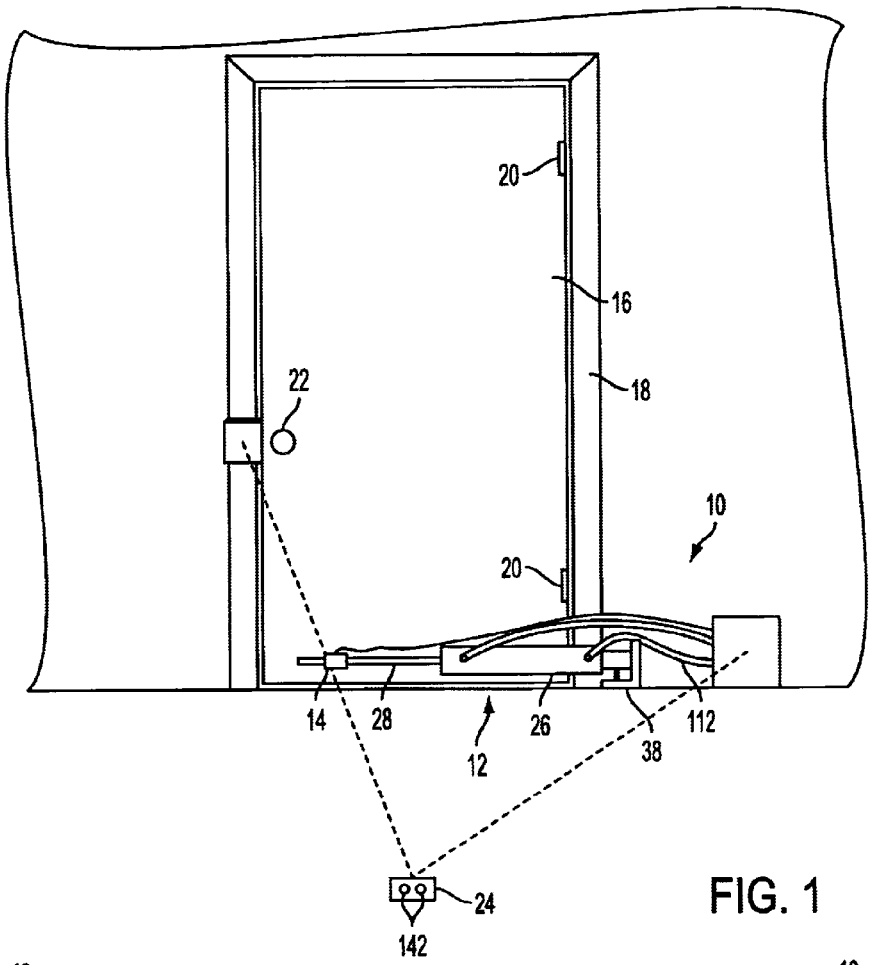
FIG. 1 is a front view of a door and door frame including the door operating mechanism of the invention.

The present invention is directed to an automatic door operating assembly for selectively opening and closing a door. More particularly, the invention is directed to a remote controlled door operating assembly.

Referring to the drawings, door operating assembly 10 includes a door actuator assembly 12 and a coupling assembly 14 for connecting the door actuator assembly 12 to a door 16. Door 16 is mounted to a door frame 18 by hinges 20 for pivoting between an open and closed position in a conventional door handle. A conventional door handle and latch assembly 22 is mounted on door 16 for latching door 16 in a closed position.

Figure 2:
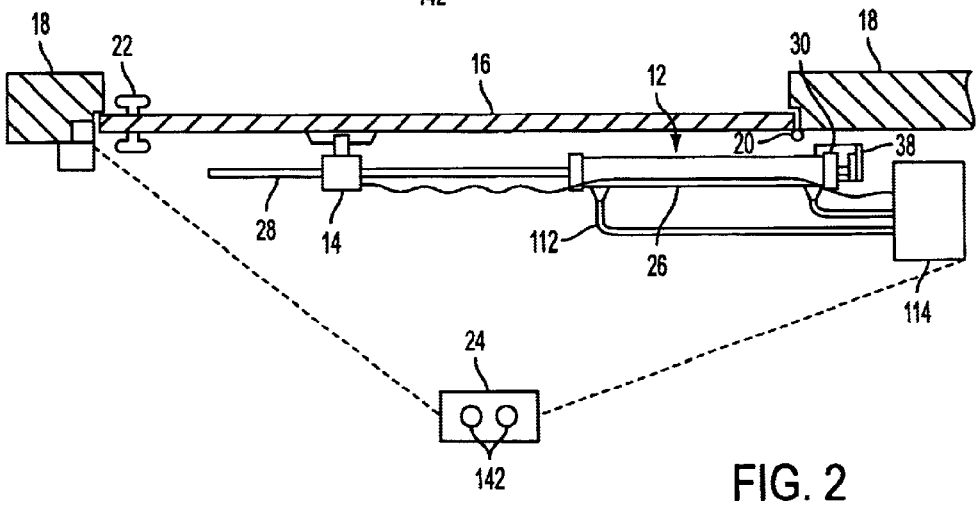
FIG. 2 is a top view of the door and door operating mechanism of the embodiment of FIG. 1 in the closed position.
Figure 3:
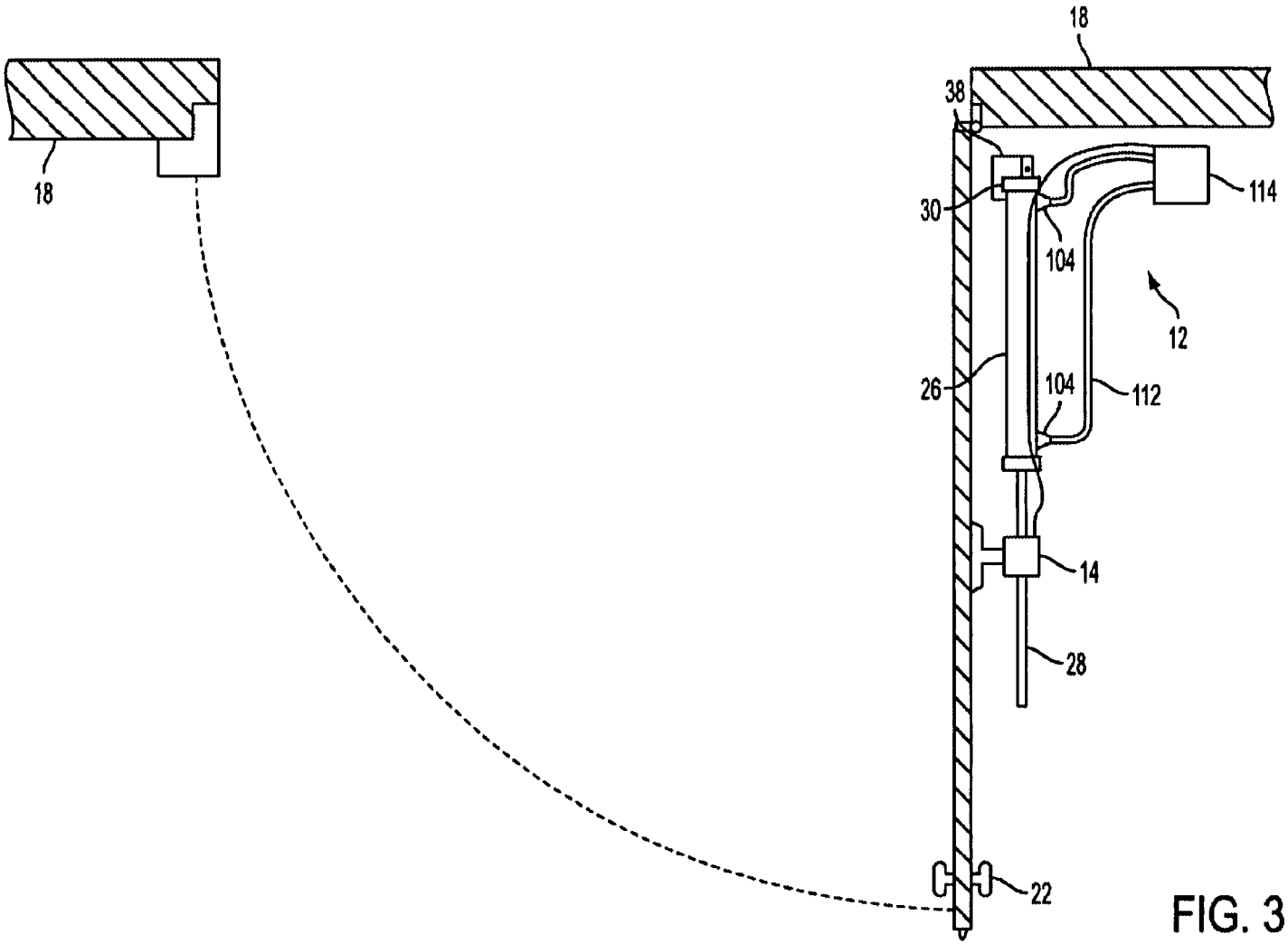
FIG. 3 is a top view of the door and door operating mechanism in the open position.
Figure 4:
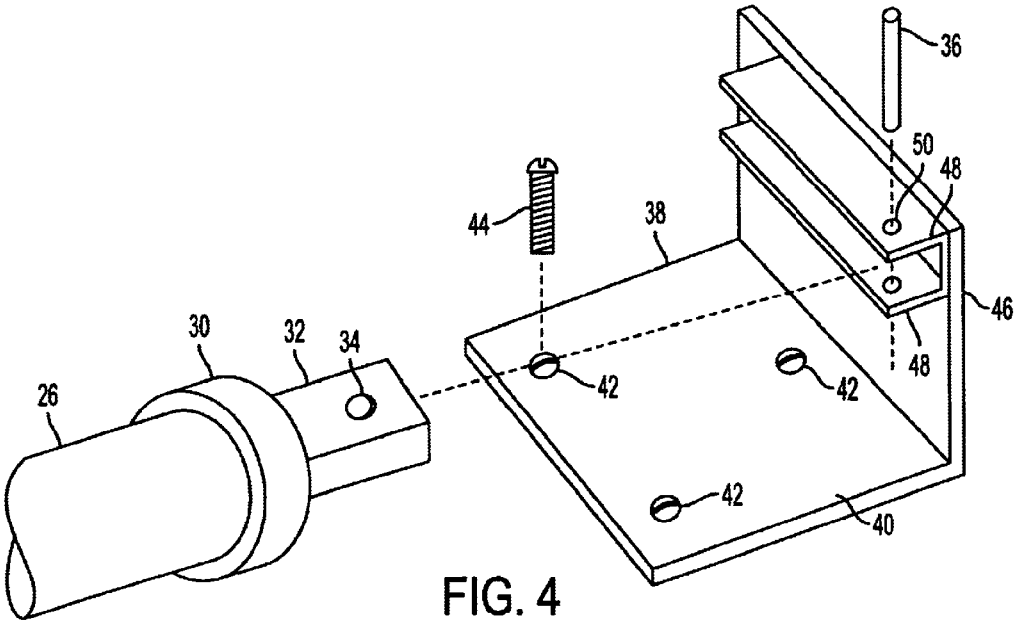
FIG. 4 is an exploded view of the floor mounting bracket and hydraulic cylinder for operating the door operating mechanism.

Referring to FIGS. 1–4, door actuating assembly 12 includes a hydraulic piston assembly 26 having an actuating rod 28. Hydraulic piston assembly 26 has a first end 30 having a coupling arm 32. As shown in FIG. 4, coupling arm 32 of hydraulic piston assembly 26 includes an aperture 34 for receiving a coupling pin 36. Coupling arm 32 is connected to a bracket 38 for pivoting movement about a vertical axis. Bracket 38 includes a bottom plate 40 for mounting directly to the floor adjacent the door frame 18. Bottom plate 40 includes a plurality of apertures 42 for receiving mounting screws 44. A plate 46 extends upwardly from bottom plate 40 and includes two spaced apart legs 48 extending generally parallel to bottom plate 40. Legs 48 include an aperture 50 for receiving coupling pin 36. Coupling arm 32 of hydraulic piston assembly 26 is received between legs 48 and coupled thereto by coupling pin 36 for pivotal movement about a vertical axis.

Figure 5:
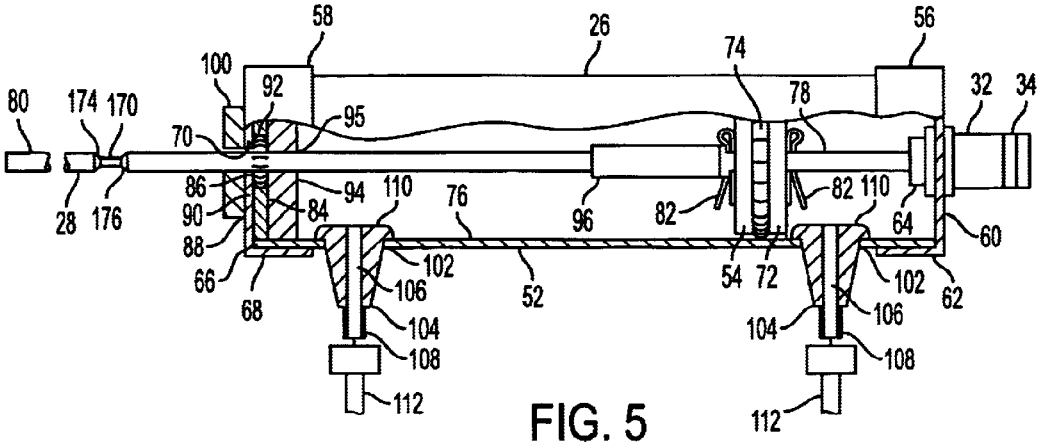
FIG. 5 is a cross-sectional view of the hydraulic cylinder of the door operating mechanism.

Referring to FIG. 5, hydraulic piston assembly 26 includes a cylinder 52 and a reciprocating piston 54 within cylinder 52. Cylinder 52 has open ends that are closed by end caps 56 and 58. End cap 56 has an end wall 60 and a side wall 62 dimensioned to fit over the end of cylinder 52. Coupling arm 32 includes a threaded end that extends through a central opening in end wall 60 of end cap 56. A threaded nut 64 is threaded onto the threaded end of coupling arm 32 for attaching coupling arm 32 to end cap 56.

End cap 58 includes an end wall 66 and a side wall 68 for coupling to the open end of cylinder 52 opposite end cap 56. End wall 66 includes a central aperture 70 for receiving actuator rod 28.

Piston 54 as shown in FIG. 5 has a radial face 72 with a groove for receiving a seal 74, such as an O-ring. Piston 54 and seal 74 are dimensioned to contact the inner surface 76 of cylinder 52 to form a fluid seal. In the embodiment illustrated, actuator rod 28 extends completely through a central aperture in piston 54.

Actuator rod 28 has a first end 78 and a second end 80. Two spaced-apart transversely extending holes extend completely through actuator rod 28 and are spaced from first end 76 for receiving cotter keys 82. Cotter keys 82 are positioned to couple actuator rod 28 to piston 54. As shown in FIG. 5, first end 78 of actuator rod 28 extends from piston 54 a sufficient distance to serve as a stop member by contacting nut 64 and limiting movement of piston 54 toward end cap 56 along the longitudinal dimension of cylinder 52.

Referring to FIG. 5, a circular support plate 84 is mounted in cylinder 52 adjacent end cap 58. Support plate 84 has a central aperture 86 for receiving actuator rod 28. Aperture 86 of support plate 84 is dimensioned for receiving a seal 92. Typically, seal 92 is an O-ring dimensioned to seal against the outer surface of actuator rod 28 and the inner surface of aperture 86. An end plate 94 is also mounted in cylinder 52 adjacent support plate 84 as shown in FIG. 5. End plate 94 also has an opening 95 aligned with aperture 86 to allow actuating rod 28 and piston 54 to reciprocate within cylinder 52. End plate 94 retains seal 92 in aperture 86.

A sleeve 96 is coupled to actuator rod 28 adjacent piston 54 opposite first end 78. Sleeve 96 can be coupled to actuator rod 28 by a friction fit or by a suitable fastener. Sleeve 96 has an outer diameter greater than opening 95 in end plate 94 so that sleeve 96 functions as a stop member to limit axial movement of piston 54 and actuator rod 28 within cylinder 52 when piston 54 moves toward end cap 58.

In embodiments of the invention, cylinder 52 and end caps 56 and 58 are made of a plastic material such as PVC having sufficient strength to withstand the hydraulic pressures and stresses necessary to open and close a door. In the embodiments of the invention where end cap 58 is made of a plastic material or other soft material, a bearing 100 is attached to the outer face of end cap 58 to reduce wear on end cap 58 by the reciprocating motion of actuator rod 28. Bearing 100 is generally made of metal or other wear resistant material. In further embodiments, cylinder 52 is made of metal, such as steel, having sufficient strength and wear resistance to operate efficiently.

Cylinder 52 includes fluid openings 102 adjacent each open end. A fluid coupling 104 extends through each opening 102 to transfer an operating fluid to cylinder 52 on opposite sides of piston 54. Each coupling 104 includes an axial passage 106 and a threaded tip 108. Fluid coupling 104 also includes a base 110 having a diameter greater than the diameter of openings 102 for retaining fluid coupling 104 in the respective opening 102. In the embodiment illustrated, each fluid coupling 104 is made of rubber of other flexible material and is able to snap into the respective opening 102.

Referring to FIG. 5, fluid coupling 104 are positioned in the side wall of cylinder 52 at opposite ends. The base 110 of each fluid coupling is positioned in the path of piston 54 so that first end 78 of actuator rod 28 and sleeve 96 have a length to limit the linear movement of piston 54 to prevent piston 54 from contacting the fluid coupling 104.

Figure 6:
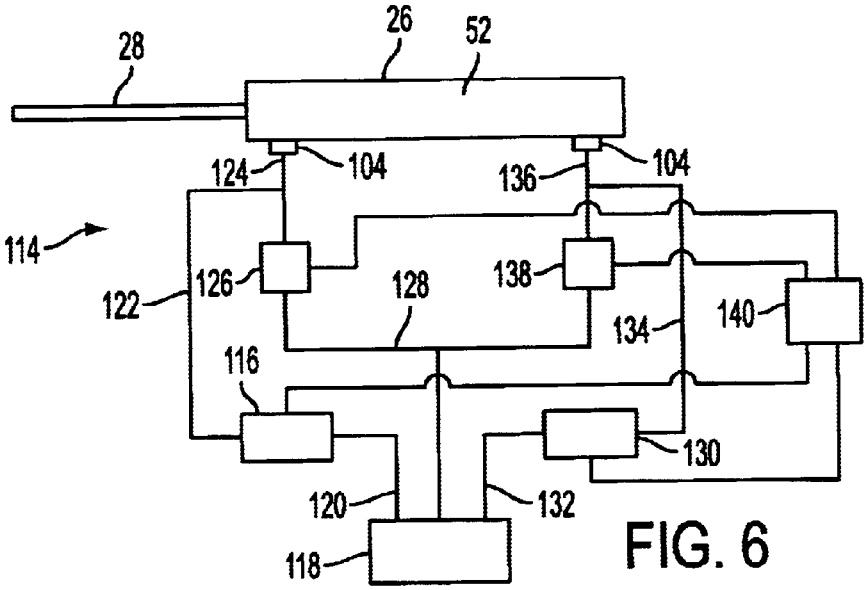
FIG. 6 is a schematic view of the pump and valve system for operating the hydraulic cylinder of the door operating mechanism.

As shown in FIG. 2, fluid couplings 104 are connected to flexible conduits 112 that are connected to a fluid control 114 for providing a fluid supply for controlling the operation of piston assembly 26. FIG. 6 is a schematic diagram of the fluid control 114 which includes a first pump 116 with a check valve allowing flow only to cylinder 52 connected to a fluid sump 118 by a line 120. Pump 116 supplies fluid through a line 122 to a line 124 which is coupled to one of the fluid couplings 104. Line 124 is also connected to a normally open valve 126 for directing fluid through a line 128 back into sump 118. A second pump 130 as above is connected to sump 118 by a line 132. Pump 130 supplies fluid under pressure through a line 134 to the second fluid coupling 104 through a line 136. Line 136 extends to a normally open valve 138 for directing fluid to line 128 for returning the fluid to sump 118. In a preferred embodiment, the operating fluid is water to eliminate the risk of fire or leakage of toxic liquids. In further embodiments, the door operating assembly can use conventional hydraulic fluids or can be pneumatically operated. Preferably, the operating pumps are operated by low voltage motors, such as 12 volt motors, to reduce the risk of electric shock.

Fluid control 114 includes a control device 140 for actuating pumps 116 and 130 and selectively opening and closing valves 126 and 138. In preferred embodiments of the invention, control device 140 is a remote control device that is operated by a hand-held remote control unit 24. Remote control unit 24 shown in FIG. 2 includes suitable electronic circuitry as known in the art for operating fluid control 114. In the embodiment illustrated in FIG. 1, remote control unit 24 is provided with two actuator buttons 142 for selectively opening and closing door 16 although the actual number of buttons can vary depending on the circuitry used. During use, remote control unit 24 is actuated to initiate an opening operation.

During the door opening operation cycle, pump 116 is actuated to pump fluid from sump 118 through line 122 into cylinder 52 to move piston 54 toward end cap 56 and retract actuator rod 28. Fluid on the opposite side of piston 54 returns to sump 118 through normally open valve 138. Control device 140 closes valve 126 to force the fluid into cylinder 52, thereby retracting actuator rod 28 from the position shown in FIG. 2 to the retracted position shown in FIG. 3. Retracting actuator rod 28 with actuating rod 28 coupled to door 16 through coupling assembly 14 causes door 16 to pivot about the hinges 20 and causes hydraulic piston assembly 26 to pivot about pin 36 on floor bracket 38 as shown in FIG. 3.

As shown in FIG. 5, first end 30 of actuator rod 28 contacts nut 64 to limit the axial movement of piston 54 and prevents piston 54 from contacting the base 110 of fluid coupling 104. In preferred embodiments, pump 116 includes a pressure sensor to sense an increase in fluid pressure in line 122 above a predetermined level. The pressure sensor is connected to control device 140 and provides an indication that piston 54 has reached the end of its stroke when the pressure increases to the predetermined level. When a threshold pressure is detected by the pressure sensor, control device 140 deactivates pump 116 to end the opening cycle. The pressure sensor in pump 116 also senses an increase in fluid pressure in line 122 if door 16 should hit an obstruction, thereby preventing movement of the door. The increase in pressure sensed causes control device 140 to deactivate pump 116 to prevent damage to pump 116 and the other components of the system as well as reducing the risk of injury to a person that may be in the way of the door.

Door 16 is closed by actuating remote control unit 24 which in turn activates control device 140. Control device 140 closes valve 138 while actuating pump 130 to supply fluid under pressure through line 134 to cylinder 52. The fluid then forces piston 54 toward end cap 58 to move actuator rod 28 to the extended position shown in FIG. 2, thereby closing door 16. The closed door against the door stop causes the increased pressure stopping the pump. This occurs before the piston reaches its maximum travel position. The fluid in cylinder 52 is then forced through line 124, normally open valve 126 and line 128 where the fluid is returned to sump 118.

In preferred embodiments of the invention, coupling assembly 14 is able to selectively engage and disengage actuator rod 28 so that door 16 can be opened and closed manually without moving actuator rod 28 and piston 54. Coupling assembly 14 is normally disengaged from actuator rod 28 so that door 16 can be open and closed manually without interference by door actuating assembly 12. Referring to FIGS. 7–11, coupling assembly 14 includes a mounting bracket 150 attached to door 16 by screws or other suitable fasteners. Bracket 150 includes a base 152 for mounting to door 16 and an outwardly extending arm 154. Arm 154 has an aperture 156 extending therethrough for receiving a pivot pin 157. A body 158 includes a U-shaped member 160 on each side of body 158 for pivotally coupling body 158 to bracket 150. U-shaped members 160 are provided on each side of body 158 to allow body 158 to be coupled to bracket 150 for accommodating doors that are hinged to the right or left side of a door frame.

Body 158 in the embodiment shown has a generally rectangular shape with a longitudinal passage 162 extending completely through body 158. Longitudinal passage 162 is dimensioned to receive actuator rod 28 and to allow actuator rod 28 to slide freely within body 158. Body 158 also includes a transverse passage 164 extending from a top surface 166 and intersects with longitudinal passage 162. A coupling member 168, shown as a pin, is mounted for movement in transverse passage 164.

Figure 7:
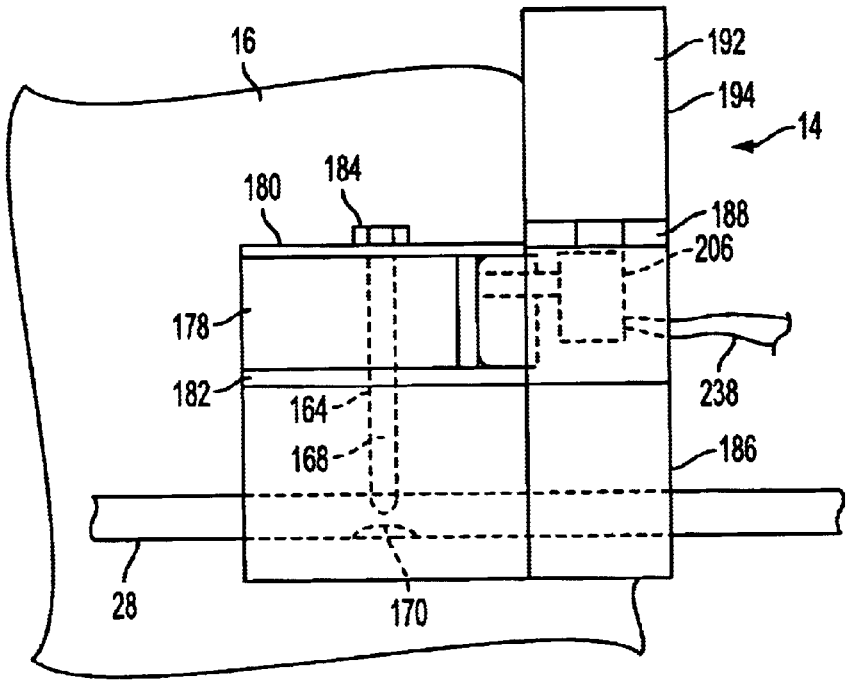
FIG. 7 is a side view of the coupling mechanism for coupling the door operating mechanism to the door.
Figure 8:
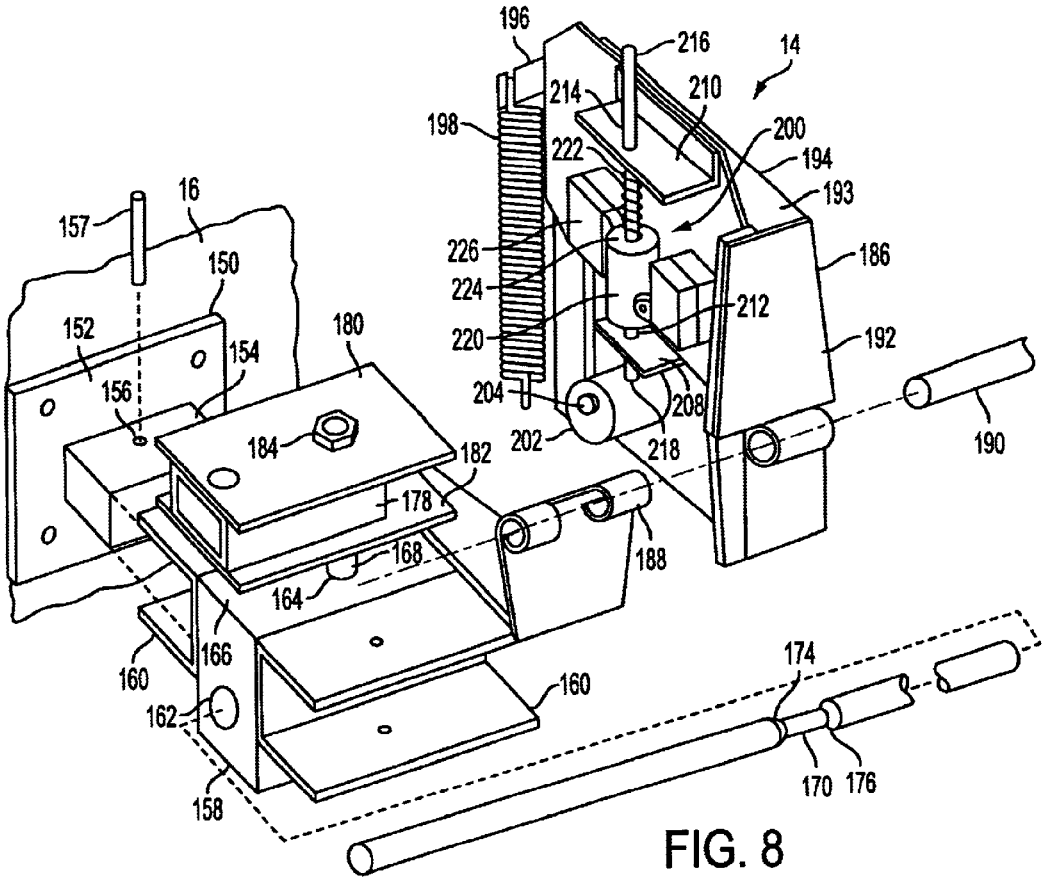
FIG. 8 is an exploded perspective view of the coupling mechanism of FIG. 7.

In preferred embodiments, actuator rod 28 has a recess 170 formed in the outer surface spaced from a second end 172 as shown in FIGS. 7 and 8. Recess 170 in rod 28 is formed with an inclined leading edge 174 and an inclined trailing edge 176. Recess 170 is dimensioned to receive coupling member 168 for affixing actuator rod 28 to coupling assembly 14 and prevent actuator rod 28 from sliding through body 158. As discussed hereinafter in greater detail, coupling member 168 is preferably spring biased toward longitudinal passage 162 when in the actuating position to be received in recess 170 of actuator rod 28.

Figure 10:
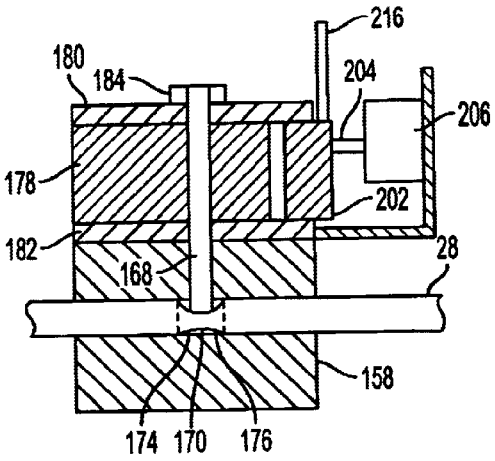
FIG. 10 is a partial cross-sectional side view of the coupling mechanism of FIG. 7 showing the detent in the coupling position.

During the operation of door actuating assembly 12, coupling member 168 is moved to the downward position shown in FIGS. 7 and 10 to capture actuator rod 28. Capturing actuator rod 28 by coupling member 168 enables door 16 to be open and closed by operation of hydraulic piston assembly 26 as discussed above. In the event door 16 contacts an obstruction or other object in its normal movement that prevents door 16 from moving, pressure increases, is sensed and the pump stops and rod 28 is released. Inclined edges 174 and 176 of recess 170 cause coupling member 168 to slide upwardly within passage 164 and allow actuator rod 28 to slide within body 158 when a sudden force is applied that is larger than the force applied during normal operation. In this manner, actuator rod 28 continues moving the movement of piston 54 but does not apply excessive force to door 16, thereby preventing damage to the various components of the assembly and preventing injury to a person that may have fallen against the door. The angle of edges 174 and 176 with respect to the axial dimension of actuator rod 28 and the spring pressure against coupling member 168 determines the force necessary to release actuator rod 28 from body 158.

Referring to FIG. 8, coupling member 168 extends through a block 178 having upper and lower camming plates 180 and 182, respectively. In the embodiment illustrated, coupling member 168 includes a threaded upper end for receiving a nut 184 for attaching coupling member 168 to block 178 and cam plates 180 and 182. As shown in FIG. 7, the lower cam plate 182 serves as a stop to limit the downward movement of coupling member 168 within transverse passage 164.

Coupling assembly 14 also includes a housing 186 that is hinged to body 158 by a hinge 188 and hinge pin 190. Housing 186 includes a side wall 192 connected to hinge 188 and an end wall 194 extending perpendicular to side wall 192. End wall 194 is provided with a hook 196 at a top end of end wall 194 opposite side wall 192. A spring 198 extends from hook 196 to U-shaped member 160. Housing 186 is able to pivot about hinge 188 and is biased by spring 198 in a downward direction toward body 158. It will be appreciated that portions of side wall 192 and top wall 193 are cut away to show the actuating assembly 200.

Figure 9:
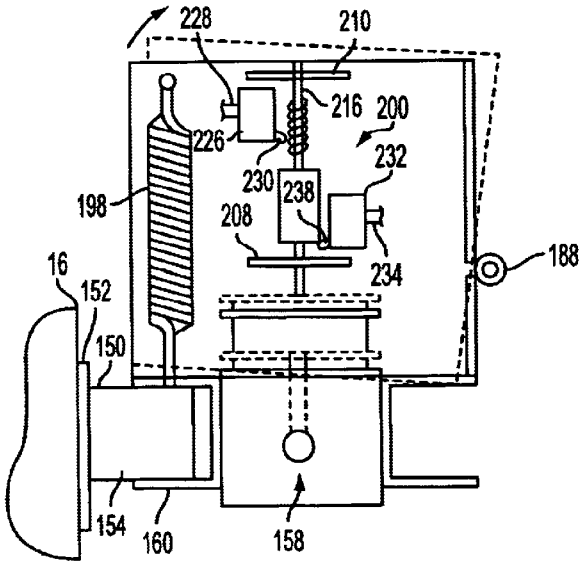
FIG. 9 is an end view of the coupling mechanism of FIG. 7.

Housing 194 supports an actuating assembly 200 for operating coupling member 168. Referring to FIGS. 8 and 9, actuating assembly 200 includes an eccentrically mounted cam 202 mounted on a shaft 204. Shaft 204 is coupled to a motor 206 for rotating cam 202. Preferably, motor 206 is a gear motor. Cam 202 is dimensioned to fit between camming plates 180 and 182. Cam 202 has a substantially cylindrical shape and is eccentrically mounted whereby rotation of shaft 204 produces a reciprocating motion to cam plates 180 and 182 and coupling member 168. As shown in FIG. 10, cam 202 has an outer end that is received between cam plates 180 and 182 and an inner end spaced from the edges of the cam plates.

A lower guide plate 208 extends outwardly from end wall 194 of housing 186 adjacent cam 202. An upper guide plate 210 extends outwardly from end wall 194 adjacent an upper end and extends generally parallel to lower guide plate 208. Lower guide plate 208 includes an aperture 212 and upper guide plate 210 includes an aperture 214 for receiving a reciprocating guide pin 216. Guide pin 216 slides through apertures 212 and 214 and includes a lower end 218 for contacting the inner end of cam 202. A stop member 220 is attached to guide pin 216 between upper guide plate 210 and lower guide plate 208. A coil spring 222 surrounds guide pin 216 and extends between upper guide plate 210 and an upper face 224 of stop member 220 to bias guide pin 216 in a downward direction toward cam 202. Preferably, spring 222 maintains lower end of guide pin 216 in constant contact with cam 202. Guide pin 216 is mounted for reciprocating movement through the respective aperture in upper guide plate 210 and lower guide plate 208, whereby rotation of cam 202 produces a reciprocating motion to guide pin 216.

Figure 11:
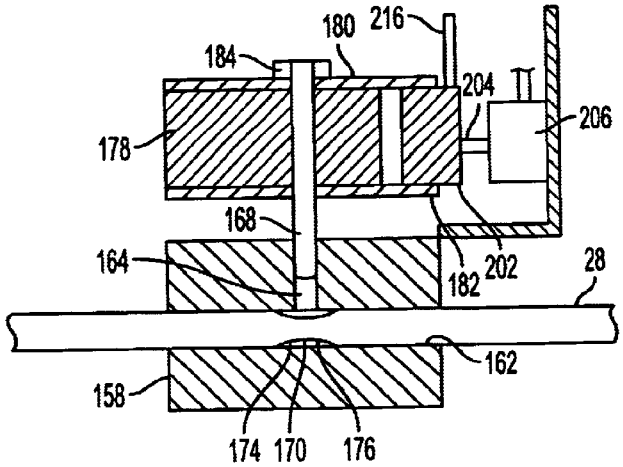
FIG. 11 is a cross-sectional side view showing the detent in the disengaged position.
Figure 11A:
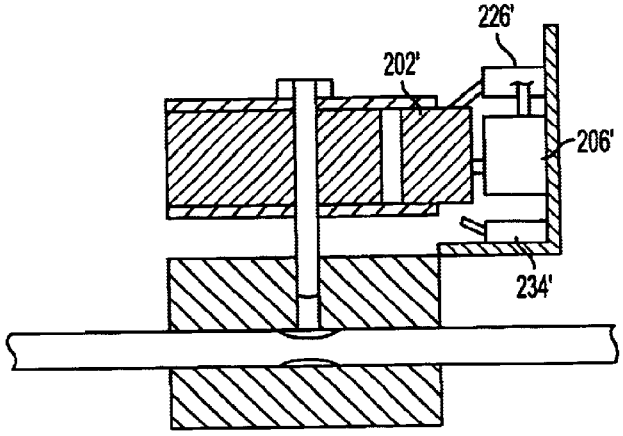
FIG. 11A is a cross-sectional side view of the microswitches in an alternative embodiment of the invention.

As shown in FIG. 9, an upper microswitch 226 is mounted on end wall 194 toward upper guide plate 210. Upper microswitch 226 is connected to motor 206 by wires 228 for controlling the operation of motor 206. Microswitch 226 includes an actuating arm 230 positioned for contacting stop member 220 when guide pin 216 is in the uppermost position. A lower microswitch 232 is mounted on end wall 194 adjacent lower guide plate 208. Lower microswitch 232 is also connected to motor 206 by wires 234 for controlling motor 206. An actuating arm 236 extends outwardly from microswitch 232 for contacting stop member 220 when guide pin 216 is in the lowermost position shown in FIG. 9. Motor 206 is connected by wires 238 to control device 140 for actuating motor 206 during the opening and closing operation of door 16. In an alternative embodiment shown in FIG. 11A, microswitches 226' and 236' are positioned to engage cam 202'. In this embodiment, cam 202 actuates the microswitches to start and stop motor 206' at the desired positions.

In operation, control device 140 operates motor 206 to control the capturing and disengagement of coupling assembly 14 to actuator rod 28. Control device 140 actuates motor 206 to rotate cam 202 about shaft 204. Rotation of cam 202 raises and lowers coupling member 168 into and out of engagement with actuator rod 28. Coupling member 168 is moved into the capturing position by rotating cam 202 whereby cam 202 pushes lower cam plate 182 downward to the position shown in FIGS. 9 and 10. When cam 202 reaches its lowermost position shown in FIG. 9, guide pin 116 is biased downwardly causing stop member 220 to contact arm 236 of lower microswitch 232. At this point, lower microswitch 232 stops the rotation of motor 206 to retain coupling member 168 in the capturing position. Coupling member 168 is disengaged by operating motor 206 causing cam 202 to rotate to the uppermost position, thereby retracting coupling member 168 within transverse passage 164. The rotation of cam 202 moves guide pin 216 in an upward direction against the spring 222 until stop member 220 contacts arm 230 of upper microswitch 226. Upper microswitch 226 then stops the rotation of motor 206 until motor 206 is again actuated by control device 140.

As shown in FIGS. 9 and 10, housing 186 is spring biased by spring 198 in a downward direction toward body 158. Spring 198 maintains coupling member 168 in contact with actuator rod 28. In the event the door is heavily impacted with a force greater than that provided by the cylinder, inclined edges 174 and 176 of recess 170 in actuator rod 28 push coupling member 168 in an upward direction causing housing 186 to which motor 206 is mounted pivots about hinge 188 as shown by phantom lines in FIG. 9. If the shoulders of the recess in rod 28 were square, the excessive force would be transmitted to the mounting hardware 38 and 14 possibly causing failure. The pivoting on hinge 188 also allows pin 168 to come down on rod 28 other than the recess location and still allow the motor to turn the cam, thus preventing stalling of the motor which would cause the motor to burn out. This action occurs if the door is partially open when the operating assembly is put in motion. In such case, the tip of pin 168 slides along rod 28 until it enters the recess. If the door is obstructed in normal operation, the pressure built up will stop the motion of the piston in the same manner as when the door reaches its open and closed positions.

Figure 12:
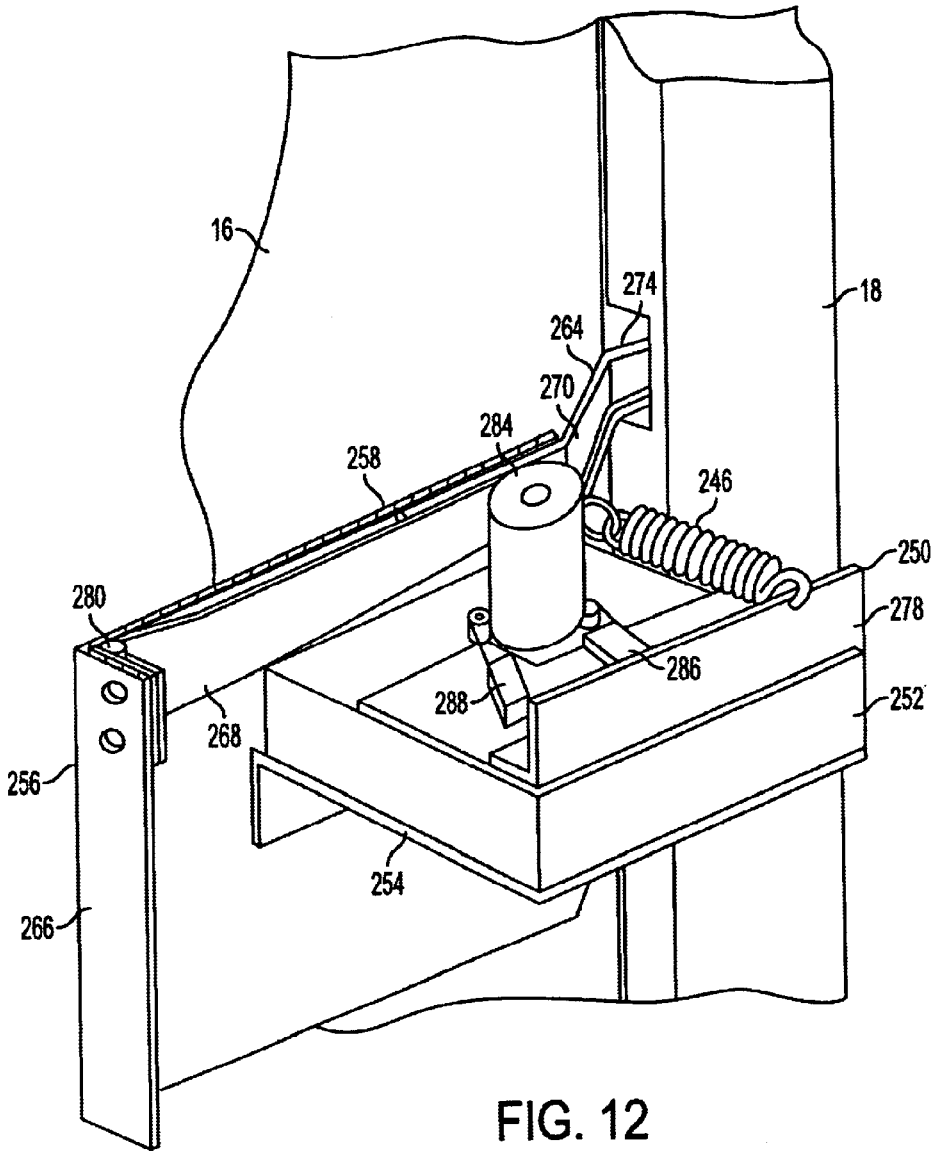
FIG. 12 is a perspective view of the strike plate release assembly in one embodiment of the invention.
Figure 13:
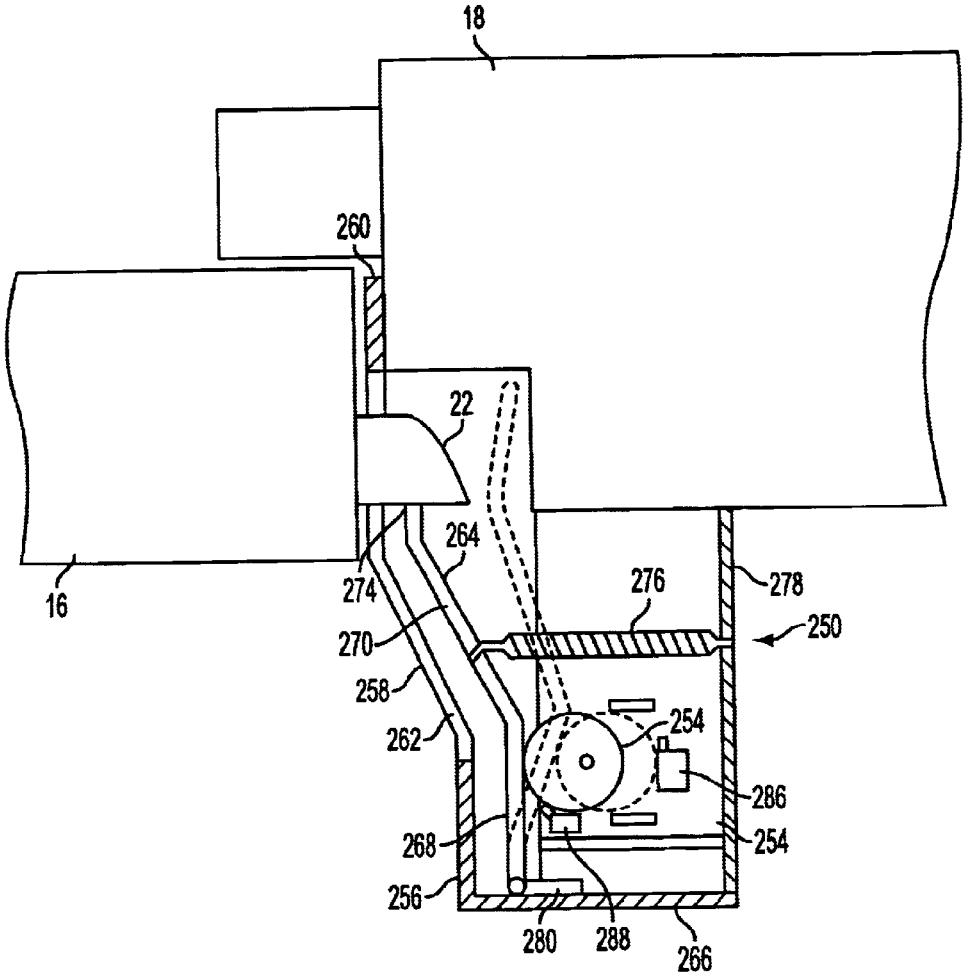
FIG. 13 is a top view in partial cross-section showing the movable strike plate in the latching position.
Figure 14:
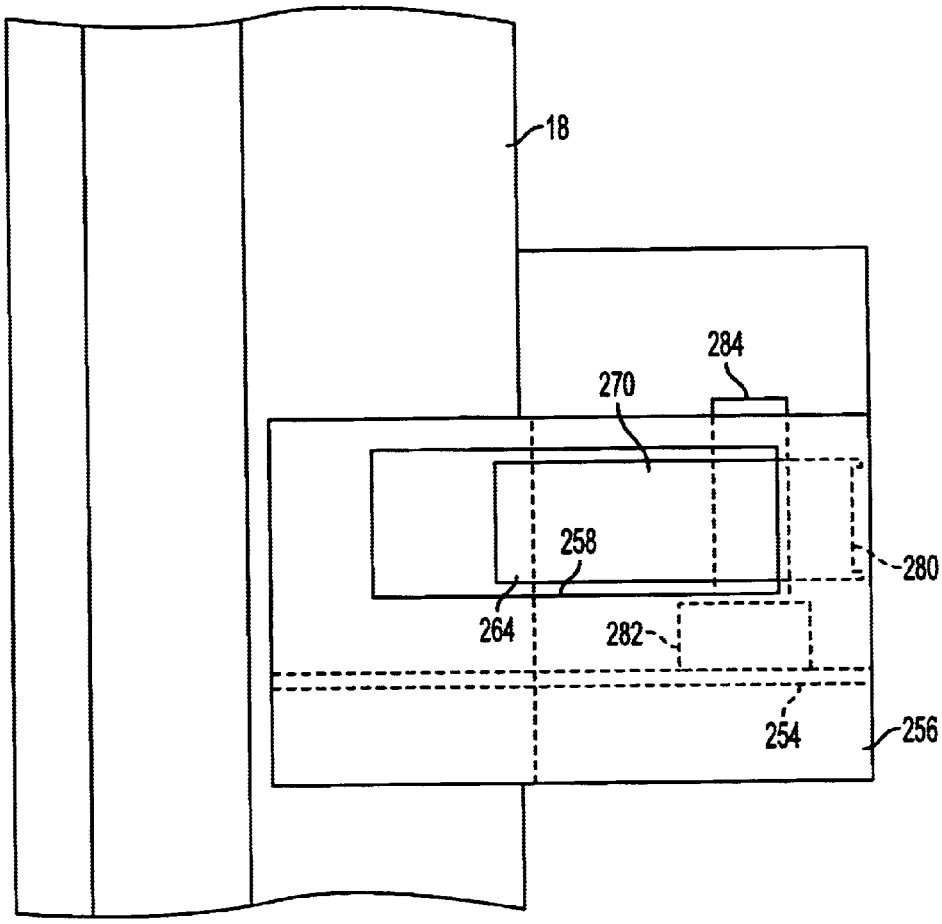
FIG. 14 is a front view of the strike plate assembly as seen with the door in the open position.

In preferred embodiments of the invention, a retractable strike plate assembly 250 is mounted on door frame 18 cooperating with door latch 22 for retaining door 16 in the closed position. Referring to FIGS. 12–14, strike plate assembly 250 includes a housing 252 and a bottom wall 254.

Housing 252 includes a front wall 256 having an angled section 258 extending as a mounting leg 260 for coupling housing 252 to door frame 18. It will be appreciated that portions of housing 252 are cut away for purposes of illustrating the various components of strike plate assembly 250. Angled section 258 and mounting leg 260 mounted either above or below the latch allow door latch 22 to pass during opening and closing of door 16. A movable strike plate 264 is hinged to an end wall 266 of housing 252 by a hinge 280. Movable strike plate 264 includes a first leg 268 connected to an angled leg 270 having an end 274 which blocks door latch 22 to retain the door in the closed position shown in FIG. 13. A spring 276 is coupled to movable strike plate 264 and a rear wall 278 of housing 252 to bias movable strike plate 264 away from front wall 256 about a hinge 280.

A motor 282 is mounted on bottom wall 254 and includes an eccentric cam 284 for moving movable strike plate 264 from a latching position to an unlatched position shown in phantom lines in FIGS. 13 and 14. Motor 282 is connected to a suitable power source and operated by control device 140 for selectively rotating cam 284 during operation of the assembly. During the door opening operation, motor 282 is operated to rotate cam 284 to the position shown in phantom lines in FIG. 13. In this position, spring 276 pivots movable strike plate 264 about hinge 280 to the position shown in phantom lines in FIG. 13. The retracted position of movable strike plate 264 releases latch 22 whereby hydraulic piston assembly 26 can open and close door 16.

A microswitch 286 is positioned on bottom wall 254 to contact cam 284 at the point when movable strike plate 264 is in the unlatched position. Microswitch 286 is electrically connected to motor 282 to stop the rotation of motor 282 and cam 284 when movable strike plate 264 is in the retracted position. During the latching and door closing operation, control device 140 actuates motor 282 to rotate cam 284 to move movable strike plate 264 to the latching position of FIG. 13. A second microswitch 288 is provided on bottom wall 254 to engage cam 284 when cam 284 reaches the latching position to stop the rotation of motor 282.

In preferred embodiments, strike plate assembly 250 is controlled remotely by control device 140 and remote control unit 24. Strike plate assembly 250 is synchronized with hydraulic cylinder assembly 26 to retract strike plate 264 when hydraulic cylinder 26 is activated. The operator actuates remote control unit 24 to begin the door opening cycle. At this point, control unit 140 actuates motor 282 to rotate cam 284 and move movable strike plate 264 to the unlatching position. Simultaneously, control unit 184 actuates motor 206 of coupling assembly 14 to move coupling member 168 into the capturing position to capture actuator rod 28. Hydraulic piston assembly 26 is then operated to open door 16 in the manner previously described. The operation is reversed to close door 16 and return strike plate 264 to the latching position and disengage coupling assembly 14 from actuator rod 28. Door 16 can then be opened and closed manually by operating door latch 22 in a conventional manner to retract into door 16 free of strike plate 264.

While various embodiments have been chosen to illustrate the invention, it will be understood by those skilled in the art that various changes and modifications can be made without departing from the spirit and scope of the invention as defined in the appended claims.

What is claimed is:

1. An apparatus for opening and closing a door hinged to a door frame, said apparatus comprising:

a first bracket for mounting on a support surface and being in a fixed position with respect to the door;

a door actuator assembly having a first end pivotally coupled to said first bracket and a second end, said actuator assembly further having an actuator rod extending from said second end of said actuator assembly and being movable between an extended position to close said door and a retracted position with respect to said door actuator assembly to open said door;

a second bracket for coupling to said door at a location spaced from said door frame, said actuator rod being slidably coupled to said second bracket; and a coupling assembly comprising a detent coupled to said second bracket for selectively engaging a recess in said actuator rod capturing said actuator rod to open and close said door by actuating said actuator rod between said extended position and said retracted position, and said detent releasing said actuator rod to allow said actuator rod to slide with respect to said second bracket to allow said door to be opened manually without interference from said actuator assembly.

2. The apparatus of claim 1, wherein said second bracket includes an aperture for receiving said actuator rod, and wherein said detent is movable between a disengaged position released from said recess of said actuator rod allowing manual movement of said door and a captured position to capture said actuator rod for opening and closing said door by movement of said actuator rod of said door actuator assembly.

3. The apparatus of claim 2, wherein said actuator rod has an outer surface with said recess therein.

4. The apparatus of claim 3, wherein said detent is spring biased into said captured position in engagement with said actuator rod so as to release said detent from said actuator rod when a predetermined force is applied to actuator rod.

5. The apparatus of claim 4, wherein said recess in said actuator rod has an inclined leading edge and an inclined trailing edge.

6. The apparatus of claim 4, wherein said detent comprises a pin having a bottom end for engaging said recess and a top end for engaging a coupling actuator.

7. The apparatus of claim 6, wherein said coupling actuator comprises a housing, said housing being spring biased with respect to said second bracket, and a cam member coupled to said housing for moving said detent into said captured position for engagement with said actuator rod.

8. The apparatus of claim 7, wherein said cam is rotatably coupled to said housing and said coupling actuator includes a motor for rotating said cam, and at least one microswitch for stopping said motor when said detent is in said disengaged position or said captured position.

9. The apparatus of claim 1, wherein said door actuator assembly comprises a piston and a cylinder for moving said actuator rod between said extended position and said retracted position.

10. The apparatus of claim 9, wherein said actuator rod is coupled to said piston and said door actuator assembly includes a fluid pump for producing reciprocating movement to said piston within said cylinder.

11. The apparatus of claim 1, wherein said actuator assembly is a double action hydraulic cylinder, said actuator assembly further comprising a pump operatively connected to said hydraulic cylinder, and a control device for operating said pump.

12. The apparatus of claim 11, wherein said control device is remote controlled.

13. The apparatus of claim 1, further comprising a door latch adapted to be coupled to said door and a strike plate adapted to be coupled to said door frame for latching said door in a closed position, wherein said strike plate is retractable to allow said door to open.

14. An automatic door operating assembly for opening and closing a door hinged to a door frame, said assembly comprising:

a first bracket for mounting on a support surface, and being in a fixed position with respect to said door;

a door actuator having a piston and a cylinder, said cylinder having a first end pivotally coupled to said first bracket and a second end spaced from said first end, an actuator rod having a first end coupled to said piston and a second end spaced from said second end of said cylinder;

a second bracket for coupling to said door;

a coupling assembly for coupling said actuator rod to said second bracket, said coupling assembly including a body coupled to said second bracket, said body having a hole defining a passage extending therethrough, said second end of said actuator rod extending through said hole and being slidable therein;

a spring biased detent coupled to said body, said detent being spring biased to an extended position for engaging in and capturing said actuator rod and being movable to a retracted position for releasing said actuator rod, said actuator rod movable between a retracted position to open said door and an extended position to close said door when said detent captures said actuator rod, and where said detent releases said actuator rod when a predetermined axial force is applied to said actuator rod.

15. The assembly of claim 14, wherein said coupling assembly includes a cam member for moving said detent between said retracted position and said extended position.

16. The assembly of claim 14, wherein said actuator rod includes a recess for receiving said detent to capture said actuating rod.

17. The assembly of claim 16, wherein said recess in said actuator rod has an inclined leading edge and an inclined trailing edge each allowing said detent to release said actuator rod.

18. The assembly of claim 14, wherein said coupling assembly comprises a frame hinged to said body, and a spring extending between said body and said coupling assembly frame to bias said coupling assembly frame toward said body.

19. The assembly of claim 18, further comprising a cam mounted on said coupling assembly frame for moving said detent between said retracted and extended positions, and a cam motor coupled to said coupling assembly frame for actuating said cam.

20. The assembly of claim 19, further comprising a fluid source for selectively supplying fluid to said cylinder to move said actuator rod between said retracted position and said extended position, and a control device for controlling said fluid source and for actuating said cam motor.

21. The assembly of claim 20, wherein said control device is a remote control device.

22. A remote operated door operating assembly, for opening and closing a door hinged to a door frame, said assembly comprising:

a first bracket for mounting on a support surface, and being in a fixed position with respect to said door;

a door actuator having a fluid operated piston and a cylinder, said cylinder having a first end pivotally coupled to said first bracket and a second end spaced from said first end;

an actuator rod having a first end coupled to said piston and a second end spaced from said second end of said cylinder, said actuator rod being movable between an extended door closing position and a retracted door opening position;

a second bracket for coupling to said door;

a coupling assembly for coupling said second end of said actuator rod to said second bracket, said coupling assembly having a coupling member movable between a retracted position to disengage said coupling member from said actuator rod, and an extended position capturing a recess in said actuator rod and enabling an opening and closing movement of said door by movement of said actuator rod;

a door latching assembly for latching said door in a closed position, said latching assembly having a movable strike plate adapted to be coupled to said door frame and being movable from a latching position to an open position to allow said door to open; and a remote control device for operating said door actuator, coupling assembly and latching assembly from a remote location to selectively open and close said door, wherein said door can be opened manually when said coupling member is in said retracted position without interference from said door actuator.

23. The assembly of claim 22, further comprising a fluid source for supplying fluid under pressure to said door actuator, and said control device for actuating said fluid source.

24. The assembly of claim 22, wherein said coupling assembly comprises a body hinged to said second bracket and having a first passage extending therethrough for slidably receiving said actuator rod.

25. The assembly of claim 24, wherein said body includes a second passage intersecting with said first passage and receiving said coupling member.

26. The assembly of claim 25, wherein said recess in said actuating rod includes an inclined leading edge and an inclined trailing edge.

27. The assembly of claim 24, further comprising a coupling assembly frame hinged to said body, a cam member coupled to said coupling assembly frame for actuating said coupling member, and a spring extending between said body and said coupling assembly frame for biasing said cam and coupling member toward said actuating rod.

28. The assembly of claim 22, wherein said coupling member of said coupling assembly is spring biased toward said actuator rod.

* * * * *